US009004506B2

(12) United States Patent
Rutz et al.

(10) Patent No.: US 9,004,506 B2
(45) Date of Patent: Apr. 14, 2015

(54) ROTATABLE BALL CART

(76) Inventors: Patrick Rutz, Folsom, CA (US); Casey Nathan Harris, Sacramento, CA (US)

( * ) Notice: Subject to any disclaimer, the term of this patent is extended or adjusted under 35 U.S.C. 154(b) by 95 days.

(21) Appl. No.: 13/472,316

(22) Filed: May 15, 2012

(65) Prior Publication Data

US 2013/0127317 A1 May 23, 2013

Related U.S. Application Data

(60) Provisional application No. 61/487,203, filed on May 17, 2011.

(51) Int. Cl.

| | |
|---|---|
| ***B62B 1/00*** | (2006.01) |
| ***A63B 47/00*** | (2006.01) |
| ***A47B 81/00*** | (2006.01) |
| ***A47B 91/00*** | (2006.01) |

(52) U.S. Cl.

CPC ..... *A63B 47/00* (2013.01); *A47B 81/00* (2013.01); *A47B 91/00* (2013.01); *A63B 47/002* (2013.01); *A63B 2225/09* (2013.01)

(58) Field of Classification Search

USPC ..... 280/30, 645, 643, 654, 655.1, 655, 280/47.33, 47.26, 63, 756–757, 764, 773

See application file for complete search history.

(56) References Cited

U.S. PATENT DOCUMENTS

| | | | | |
|---|---|---|---|---|
| 99,985 | A * | 2/1870 | Wegner | 366/226 |
| 3,235,212 | A * | 2/1966 | Baumiller, Jr. | 248/142 |
| 5,368,351 | A * | 11/1994 | Cuti | 294/19.2 |
| 5,507,541 | A * | 4/1996 | Chen et al. | 294/19.2 |
| 5,580,015 | A * | 12/1996 | Baker | 248/145 |
| 5,860,658 | A * | 1/1999 | Callahan | 280/30 |
| 6,953,128 | B2 * | 10/2005 | Pfister et al. | 220/507 |
| 7,172,165 | B1 * | 2/2007 | Young | 248/314 |
| 7,582,031 | B2 * | 9/2009 | Runck | 473/459 |
| 2004/0016854 | A1 * | 1/2004 | Hart | 248/141 |
| 2004/0231063 | A1 * | 11/2004 | Rhode et al. | 8/159 |

* cited by examiner

*Primary Examiner* — John Walters
*Assistant Examiner* — James Triggs
(74) *Attorney, Agent, or Firm* — Haverstock & Owens LLP

(57) ABSTRACT

A ball cart comprising a removable and rotatable ball basket having a plurality of separated chambers that are each able to hold a different kind of ball. Thus, whenever a particular type of ball is desired, a user is able to rotate the basket and lock it in place such that a lid of the chamber that holds balls of that type is accessible to the user. As a result, the user is able to easily select that type of balls desired from the ball cart without sifting through all of the balls in the ball cart.

16 Claims, 3 Drawing Sheets

ROTATABLE BALL CART

RELATED APPLICATIONS

This Patent Application claims priority under 35 U.S.C. 119 (e) of the U.S. Provisional Patent Application Ser. No. 61/487,203, filed May 17, 2011, and entitled, "ROTATABLE BALL CART." The Provisional Patent Application, Ser. No. 61/487,203, filed May 17, 2011, and entitled, "ROTATABLE BALL CART" is also hereby incorporated by reference.

FIELD OF THE INVENTION

The invention relates to a method and apparatus for ball storage. Specifically, the invention relates to a rotatable ball cart and method.

BACKGROUND OF THE INVENTION

Currently, in order to reduce the time wasted gathering balls, tennis and other sport instructors use large ball carrying carts capable of conveniently holding and transporting large numbers of balls for use when instructing an athlete. Generally, these carts comprise a single cavity for holding the balls and an opening for allowing the instructor to retrieve the balls as desired. However, when an instructor needs multiple balls of different shapes and sizes, the ball carts are less effective because they require effort by the instructor to sift through the balls in the cavity and select a particular ball of a desired size and shape. Indeed, because this wasted time and effort needs to be repeated each time new ball is required, it quickly becomes tiresome and frustrating. As a result, the athletes are afforded less time for actual instruction with their instructors.

SUMMARY OF THE INVENTION

A ball cart comprising a removable and rotatable ball basket having a plurality of separated chambers that are each able to hold a different kind of ball. Thus, whenever a particular type of ball is desired, a user is able to rotate the basket and lock it in place such that a lid of the chamber that holds balls of that type is accessible to the user. As a result, the user is able to easily select that type of balls desired from the ball cart without sifting through all of the balls in the ball cart.

A first aspect of the present application is directed to a rotatable ball cart for holding one or more balls. The rotatable ball cart comprises a container having a plurality of chambers separated by one or more dividers, a frame coupled to the container in order to support the container at a desired height and a rotation assembly coupled to the container, wherein the rotation assembly enables the container to be rotated about an axis with respect to the frame. In some embodiments, each chamber comprises a lid that provides access to the chamber from the exterior of the container. In some embodiments, each lid comprises a sealing mechanism that enables a user to selectively prevent the lid from opening. In some embodiments, the container is a cage such that the interior of the container is visible from the exterior of the container. In some embodiments, the container is able to be selectively attached or detached from the rotation assembly and the frame by a coupling mechanism such that the container is able to be removed from the frame and rotation assembly. In some embodiments, the cart further comprises a rotation locking mechanism that enables the container to be held in place at a plurality angles with respect to the frame. In some embodiments, the rotation locking mechanism comprises a push/pull bar coupled to the frame that is able to be selectively inserted into a plurality of apertures on the container. In some embodiments, the position of the one or more dividers within the container is adjustable such that the number and size of the chambers is able to be adjusted. In some embodiments, the rotation assembly comprises a handle that protrudes from the frame and when rotated causes the basket to rotate.

Another aspect of the present application is directed to a method of operating a rotatable ball cart for holding one or more balls. The method comprises unlocking a rotation locking mechanism enabling a container having a plurality of chambers to rotate with respect to a frame supporting the container, rotating the container to a desired angle with respect to the frame with a rotation assembly, locking the rotation locking mechanism preventing the container from rotating with respect to the frame and accessing one or more of the chambers of the container. In some embodiments, each chamber comprises a lid that enables the access of the chamber. In some embodiments, the method further comprises selectively sealing the chambers with a sealing mechanism of each lid, wherein the sealing of the chambers prevents the lid from opening when not being accessed. In some embodiments, the container is a cage such that the interior of the container is visible from the exterior of the container. In some embodiments, the method further comprises coupling the container with the rotation assembly and the frame with a coupling mechanism such that the container is able to be rotated within the frame by the rotation assembly. In some embodiments, the rotation locking mechanism comprises a push/pull bar coupled to the frame that is able to be selectively inserted into a plurality of apertures on the container in order to prevent rotation of the container. In some embodiments, the method further comprises adjusting the position or amount of one or more dividers that separate the chambers within the container. In some embodiments, the rotation assembly comprises a handle that protrudes from the frame and when rotated causes the basket to rotate.

Another aspect of the present application is directed to a rotatable tennis ball cart for holding one or more balls. The rotatable tennis ball cart comprises a porous cage having a plurality of chambers separated by one or more dividers, wherein the number and position of the dividers within the cage is adjustable, a frame having wheels and a handle detachably coupled to the container in order to support the container at a desired height, a rotation assembly coupled to the container, wherein the rotation assembly enables the container to be rotated about an axis with respect to the frame and a rotation locking mechanism coupled with the frame that enables the container to be held in place at a plurality angles with respect to the frame, wherein each chamber has lid that enables one or more balls within the chamber to be accessed.

DETAILED DESCRIPTION OF THE PRESENT INVENTION

The ball cart described herein is designed to allow an instructor or other user to conveniently store two or more different types of balls, wherein the balls are separated such that one does not need to sift through all of the balls to find the desired type of ball. The ball cart comprises a rotatable ball basket having a plurality of separated chambers that are each able to hold a different kind of ball. Thus, whenever a particular type of ball is desired, a user is able to rotate the basket and lock it in place such that a lid of the chamber that holds balls of that type is accessible to the user. As a result, the user is able to easily select that type of balls desired from the ball cart without sifting through all of the balls in the ball cart. For example, a tennis instructor is able to use the ball cart to separate quick-start tennis balls, dead tennis balls and regular tennis balls in separate chambers of the ball basket and then selectively choose which type of ball to access from the ball cart depending on the needs of the tennis student.

Figure 1B:
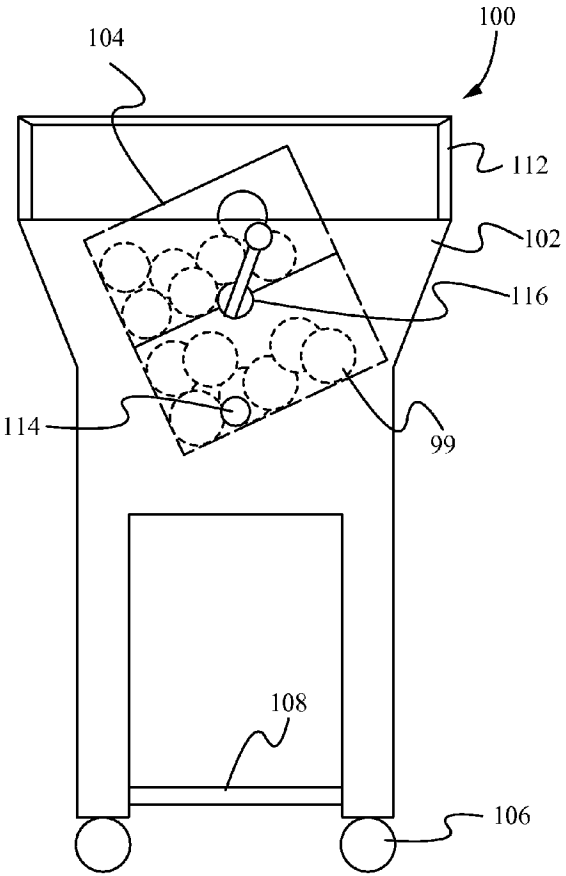
FIG. 1B illustrates front view of the rotating ball cart according to some embodiments.
Figure 1A:
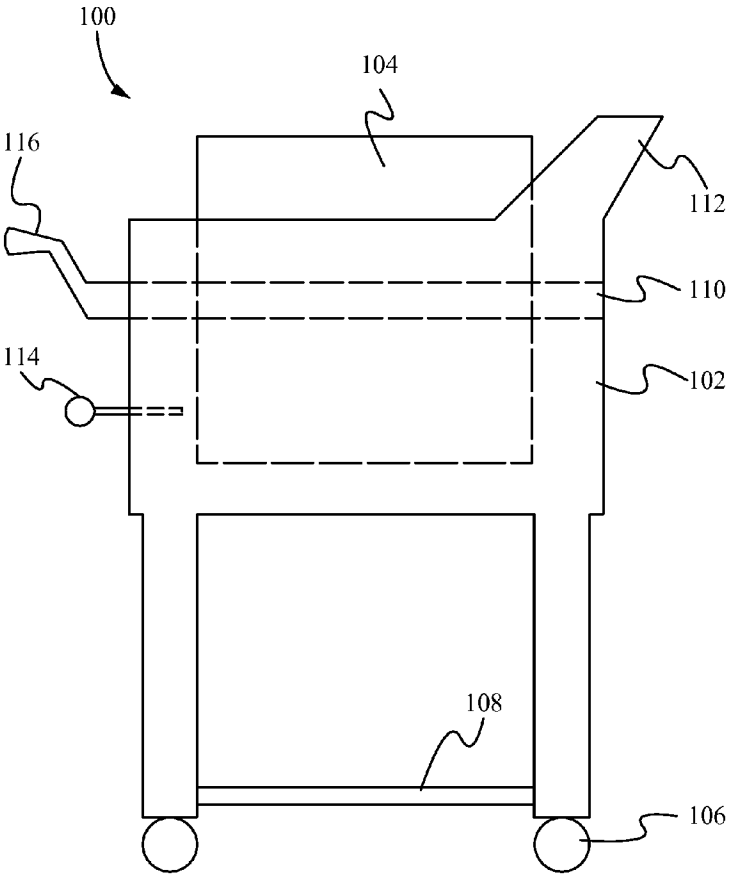
FIG. 1A illustrates a profile view of the rotating ball cart according to some embodiments.

FIGS. 1A and 1B illustrate a side and front view of a ball cart 100 according to some embodiments. As shown in FIGS. 1A and 1B, the ball cart 100 comprises a frame 102, a basket 104 for holding one or more objects 99, one or more wheels 106, one or more shelves 108, a crossbar 110, a handle 112, at least one locking mechanism 114 and at least one rotating mechanism 116. In some embodiments, one or more of the wheels 106, the shelves 108, the handle 112, locking mechanism 114 and/or rotating mechanism 116 are able to be omitted. The basket 104, wheels 106, shelves 108, crossbar 110, handle 112 and locking mechanism are detachably coupled to the frame 102. Alternatively, one or more of the basket 104, wheels 106, shelves 108, crossbar 110, handle 112 and/or locking mechanism 114 are able to be permanently coupled to the frame 102. In some embodiments, the handle 112, shelves 108, crossbar 110, locking mechanism 114 and/or rotating mechanism 116 are able to be formed as integral portions of the frame 102.

The handle 112 is positioned on top of the frame 102 such that a user is able to easily reach and manipulate the cart 100 by grabbing the handle 112. The wheels 106 are positioned on the bottom of the frame 102 such that one or more of the wheels 106 support the weight of the cart 100 when the cart 100 is in an upright position. Alternatively, the wheels 106 are able to be positioned on the bottom of one side of the frame 102 such that the cart 100 is able to be tilted along the wheels 106 when a user desires to move the cart 100 and the wheels 106 along with one or more legs of the frame 102 support the cart 100 when the cart 100 is in an upright position. The ends of the crossbar 110 are coupled to the frame 102 such that the crossbar 110 is positioned through the space/cavity found within the frame 102. As a result, the basket 104 is able to couple to the crossbar 110 such that the basket 104 is suspended at least partially within the frame 102, and further such that the basket 104 is able to rotate with the crossbar 110 acting as an axis or axle. In some embodiments, the crossbar 110 is coupled to the basket 104 such that if the crossbar 110 is rotated so is the basket 104. Alternatively, the basket 104 is supported by the crossbar 110, but is able to rotate or not rotate independent of any rotation of the crossbar 110. A shown in FIGS. 1A and 1B, a shelf 108 is positioned along the bottom of the frame 102 such that the shelf 108 is able to support/store items underneath the basket 104. Alternatively, the shelf or additional shelves 108 are able to be positioned higher on the frame 102 enabling the cart 100 to store additional items.

The locking mechanism 114 is positioned along the front surface of the frame 102 in a plane that is substantially perpendicular to the crossbar 110. Alternatively, the locking mechanism 114 is able to be positioned along the back surface of the frame 102 or in another position on the frame 102 where the locking mechanism 114 is able to access the basket 104. In some embodiments, the locking mechanism 114 comprises a push/pull bar that is able to be pushed into one or more securing apertures 210 (see FIGS. 2A and 2B) such that the basket 104 is secured at a desired angle. Alternatively, the locking mechanism 114 is able to comprise other blocking-based locking mechanisms that block the rotation of the rotation mechanism 116 and/or basket 104. Alternatively, the locking mechanism 114 is able to comprise a friction-based or brake mechanism that prevents the rotation of the basket 104 and/or rotation mechanism 116 due to friction applied to the rotation mechanism 116 and/or the basket 104. In such embodiments, the basket 104 is able to be secured at any angle with respect to the frame 102. Alternatively, the locking mechanism 114 is able to comprise other types of locking mechanisms as are well known in the art. The rotating mechanism 116 is able to be detachably or permanently coupled to the crossbar 110 such that the rotating mechanism 116 is able to rotate the crossbar 110. Thus, in embodiments where the rotation of the crossbar 110 and the basket 104 are dependent, the rotation mechanism 116 is able to rotate the basket 104 as desired by rotating the crossbar 110. Alternatively, the rotating mechanism 116 is able to be directly coupled to the basket 104 such that the rotating mechanism 116 is able to rotate the basket 104 as desired. Alternatively, the rotating mechanism 116 is able to be omitted such that a user directly contacts the basket 104 in order to manually cause the basket 104 to rotate.

In some embodiments, the frame 102 and/or basket 104 are made of metal. Alternatively, the frame 102 and/or basket 104 are able to be made of any combination of metal, plastic, wood or other building material as are well known in the art. In some embodiments, the frame 102 is angled with respect to the ground or otherwise positioned in relation to the basket 104 such that the basket 104 is able to rotate without being obstructed by the frame 102. Alternatively, the frame 102 is able to be positioned such that the frame 102 stops the rotation of the basket 104 by obstructing the movement of the basket 104 at a desired angle. Alternatively, the frame 102 is able to be adjustable such that the frame 102 is able to be moved between expanded position that enables the basket 104 to freely rotate and a contracted position that prevents the basket 104 from substantially rotated to a different orientation. For example, this extendable/retractable embodiment of the frame 102 is able to be utilized in lieu of a locking mechanism 114.

Figure 2A:
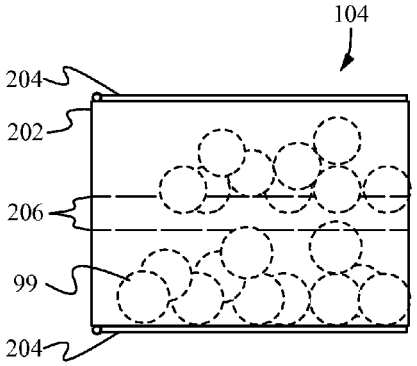
FIG. 2A illustrates a profile view of a basket according to some embodiments.
Figure 2B:
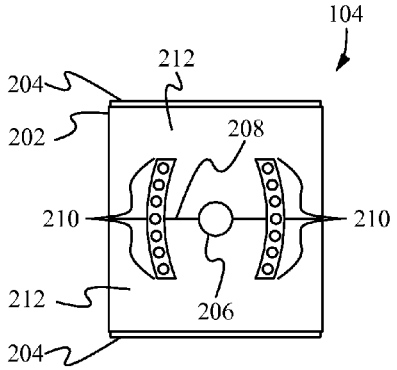
FIG. 2B illustrates a front view of a basket according to some embodiments.
Figure 3:
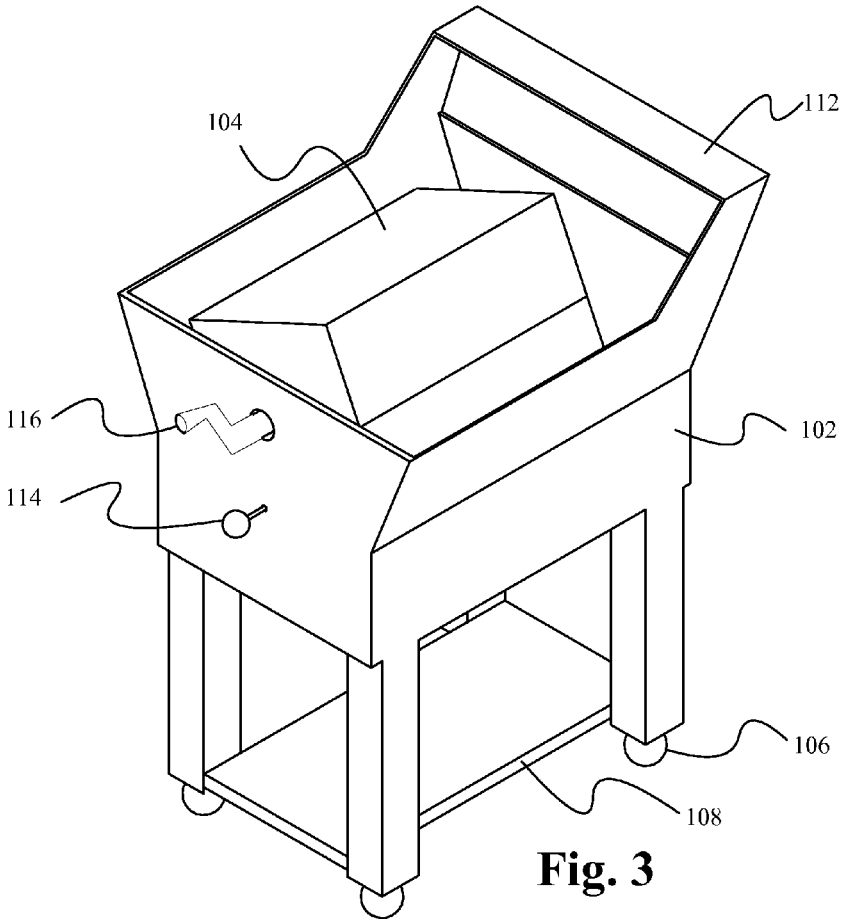
FIG. 3 illustrates a perspective view of a ball cart according to some embodiments.

FIGS. 2A, 2B and 3 illustrate a front, profile and perspective view of the basket 104 according to some embodiments. As shown in FIGS. 2A and 2B, the basket 104 comprises a body 202 having a plurality of compartments 212 for holding objects 99 such as assorted balls, one or more lids 204 for each compartment 212, a conduit 206 for receiving the crossbar 110, one or more dividers 208 that separate the compartments 212, and one or more securing elements 210 for releasably coupling to the locking mechanism 114. In some embodiments, the body 202 has a plurality of bars such that the body is in the form of a cage allowing a user to observe the contents of the body 202 without opening a lid 204. Alternatively, the body 202 is able to be partially or fully solid such that in some cases a user is required to open a lid 204 in order to observe the contents of one or more compartments of the body 202. The external dimensions of the body 202 are able to be substantially cubical. Alternatively, the external dimensions of the body 202 are able to be cylindrical, spherical or another shape capable of housing a plurality of internal compartments 212. In some embodiments, the basket 104 is removable and/or modular such that the basket 104 is able to be easily removed from the frame 102 and replaced by another basket 104 with different characteristics such as body 202 shape and compartment 212 size and/or quantity.

The compartments 212 are formed by the dividers 208 that divide the space within the body 202. Although as shown in FIGS. 2A and 2B, the dividers 208 are aligned with the conduit 206, one or more of the dividers 208 are able to be perpendicular or at other angles with respect to the conduit 206 in order to create different sized and shaped compartments 212. For example, multiple compartments 212 are able to be formed on a single side of the basket 104 such that all of the compartments 212 on that side of the basket 104 are simultaneously accessible when that side is exposed to a user. The dividers 208 are able to be any combination of solid, porous, flexible and/or rigid. In some embodiments, the dividers 208 are removable and/or adjustable such that the number and size of the compartments 212 is able to be adjusted as desired by a user. In particular, the inside of the basket 104 is able to comprise a plurality of divider fasteners (not shown) that enable a user to selectively fasten the dividers 208 into one or more positions within the basket 104. In some embodiments, the divider fasteners are movable within the inside of the basket 104 such that the position at which they fasten the dividers 208 within the basket 104 is able to be adjusted. Alternatively, one or more of the dividers 208 are able to be a part of or permanently attached to the basket 104 such that they are immovable.

As shown in FIGS. 2A and 2B, the body 202 comprises two compartments 212. Alternatively, any number of compartments 212 and/or dividers 208 is contemplated. In some embodiments, the compartments 212 are all approximately equal in size and/or dimension. Alternatively, the compartments 212 are able to be unequal in size and dimension. As described above, each compartment 212 is able to have one or more lids 204 that a user is able to open in order to access the contents of each compartment 212. In some embodiments, one or more of the lids 204 comprise a locking element (not shown) that when locked prevents the lid 204 from opening. Alternatively, one or more of the lids 204 are able to be spring biased such that the lids 204 automatically close and remain closed (despite the force of the contents within the compartment 212) unless a user provides sufficient force to cause the lid 204 to open. Alternatively, one or more of the lids 204 are able to only open inwards such that the outward force applied by the balls 99 cannot cause the lids 204 to open.

In some embodiments, the securing elements 210 are one or more apertures positioned along a line of rotation of the basket 104 for receiving a securing rod of the locking mechanism 114. Alternatively, the securing elements 210 are able to be other elements capable of securing the basket 104 at a desired angle relative to the frame 102 as are well known in the art. Alternatively, the securing elements 210 are able to be omitted. The conduit 206 is able to extend fully or partially through the space within the body 202 and be dimensioned such that the crossbar 110 fits within the conduit 206. Alternatively, the conduit 206 is able to comprise a channel that extends to the exterior of the basket 104 such that the basket 104 is able to be slid onto the crossbar 110 like a saddle. In some embodiments, the conduit 206 detachably couples with the crossbar 110 such that if the crossbar 110 is rotated the crossbar 110 causes the conduit 206 and thereby the basket 104 to rotate. Alternatively, the basket 104 is able to rotate independent of the crossbar 110 such that the crossbar 110 is able to remain stationary or otherwise move independent of the basket 104 movement. In some embodiments, the conduit 206 is able to be omitted and one or more crossbars 110 are able to couple to the exterior of the body 202 such that the basket 104 is able to pivot about the coupling point. Alternatively, other means of rotatably coupling the basket 104 to the frame 102 are contemplated as are well known in the art.

Figure 4:
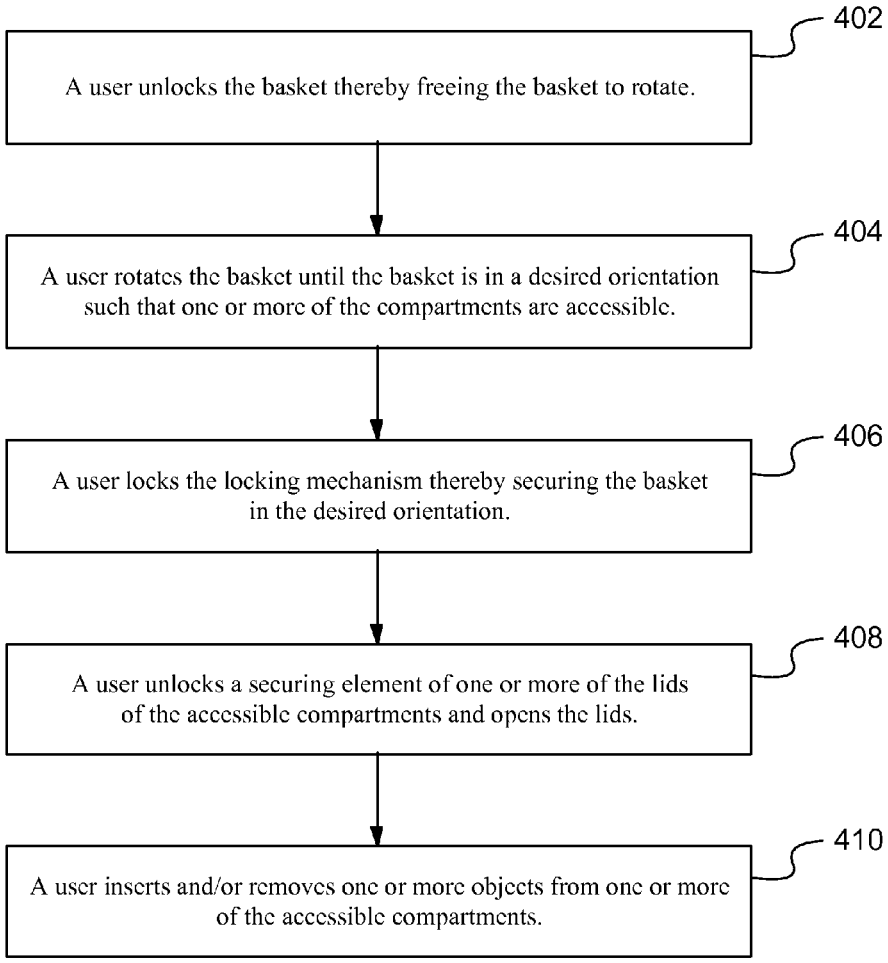
FIG. 4 illustrates a flow chart of a method of operating the rotating ball cart according to some embodiments.

The operation of the ball cart 100 will now be discussed in conjunction with the flow chart illustrated in FIG. 4. In particular, a user unlocks the basket thereby freeing the basket to rotate at the step 402. In some embodiments, the basket is unlocked by disengaging a locking mechanism. Alternatively, in addition to or in leu of unlocking the locking mechanism, the user is able to adjust the position of the frame such that the basket is able to rotate without obstruction from the frame. For example, a user is able to extend or "fan out" the sides of the frame such that the sides angle outwards thereby permitting the basket to unimpededly rotate and then retract the sides of the frame to secure the basket in a desired orientation relative to the frame. In such embodiments, the locking mechanism is able to be omitted or is able to be used to secure the basket at a desired angle even while the frame is in the extended position. A user rotates the basket until the basket is in a desired orientation such that one or more of the compartments are accessible at the step 404. In some embodiments, the rotation is effectuated using a rotation mechanism that causes the basket to rotate. Alternatively, the user is able to manually cause the basket to rotate by applying force to the basket. A user locks the locking mechanism thereby securing the basket in the desired orientation at the step 406. In some embodiments, the locking is able to be effectuated by locking the locking mechanism and/or retracting the sides of the frame. A user unlocks a securing element of one or more of the lids of the accessible compartments and opens the lids at the step 408. In some embodiments, the unlocking is unnecessary because the lid is unlocked and/or the lid does not have a securing element. A user inserts and/or removes one or more objects from one or more of the accessible compartments at the step 410. For example, a tennis instructor is able to remove a particular type of tennis ball needed from the compartments of the basket holding said type of tennis ball. In some embodiments, a user is able to adjust the size and/or number of the compartments in the basket by removing or adjusting the dividers 208. In some embodiments, a user is able to remove the basket from the frame such that the basket is able to be replaced by a different basket or to better access the chambers of the basket. As a result, the ball cart 100 provides the advantage of allowing a user to select a desired type of ball without filtering through all of the types of balls within the basket thereby saving time and energy.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A rotatable ball cart for holding one or more balls comprising:

a. a container having a first chamber and a second chamber separated by one or more dividers;

b. a frame coupled to the container in order to support the container at a desired height; and c. a rotation assembly coupled to the container, wherein the rotation assembly enables the container to be rotated about an axis with respect to the frame to position a selective one of the first chamber and the second chamber in a top exposed configuration allowing access into the selective one of the first chamber and the second chamber, wherein each of the first chamber and the second chamber comprises a lid that provides access to the chamber from the exterior of the container when the chamber is positioned in the top exposed configuration.

2. The cart of claim 1, wherein each lid comprises a sealing mechanism that enables a user to selectively prevent the lid from opening.

3. The cart of claim 1, wherein the container is a cage such that the interior of the container is visible from the exterior of the container.

4. The cart of claim 1, wherein the container is able to be selectively attached or detached from the rotation assembly and the frame by a coupling mechanism such that the container is able to be removed from the frame and rotation assembly.

5. The cart of claim 1, further comprising a rotation locking mechanism that enables the container to be held in place at a plurality angles with respect to the frame.

6. The cart of claim 5, wherein the rotation locking mechanism comprises a push/pull bar coupled to the frame that is able to be selectively inserted into a plurality of apertures on the container.

7. A rotatable ball cart for holding one or more balls comprising:

a. a container having a first chamber and a second chamber separated by one or more dividers, wherein the position of the one or more dividers within the container is adjustable such that the size of the first and second chambers is able to be adjusted;

b. a frame coupled to the container in order to support the container at a desired height; and c. a rotation assembly coupled to the container, wherein the rotation assembly enables the container to be rotated about an axis with respect to the frame to position a selective one of the first chamber and the second chamber in a top exposed configuration allowing access into the selective one of the first chamber and the second chamber.

8. The cart of claim 1, wherein the rotation assembly comprises a handle that protrudes from the frame and when rotated causes the basket to rotate.

9. A method of operating a rotatable ball cart for holding one or more balls, the method comprising:

a. unlocking a rotation locking mechanism enabling a container having a first chamber and a second chamber to rotate with respect to a frame supporting the container;

b. rotating the container to a desired angle with respect to the frame with a rotation assembly thereby exposing and allowing access into a selective one of the first chamber and the second chamber;

c. locking the rotation locking mechanism preventing the container from rotating with respect to the frame; and d. accessing the selective one of the first chamber and the second chamber of the container, wherein each of the first and second chambers comprises a lid that enables the access of the chamber.

10. The method of claim 9, further comprising selectively sealing the chambers with a sealing mechanism of each lid, wherein the sealing of the chambers prevents the lid from opening when not being accessed.

11. The method of claim 9, wherein the container is a cage such that the interior of the container is visible from the exterior of the container.

12. The method of claim 9, further comprising coupling the container with the rotation assembly and the frame with a coupling mechanism such that the container is able to be rotated within the frame by the rotation assembly.

13. The method of claim 9, wherein the rotation locking mechanism comprises a push/pull bar coupled to the frame that is able to be selectively inserted into a plurality of apertures on the container in order to prevent rotation of the container.

14. The method of claim 9, further comprising adjusting the position or amount of one or more dividers that separate the first and second chambers within the container.

15. The method of claim 9, wherein the rotation assembly comprises a handle that protrudes from the frame and when rotated causes the basket to rotate.

16. A rotatable tennis ball cart for holding one or more balls, the rotatable tennis ball cart comprising:

a. a porous cage having a first chamber and a second chamber separated by one or more dividers, wherein the number and position of the dividers within the cage is adjustable;

b. a frame having wheels and a handle detachably coupled to the container in order to support the container at a desired height;

c. a rotation assembly coupled to the container, wherein the rotation assembly enables the container to be rotated about an axis with respect to the frame thereby exposing and allowing access into a selective one of the first chamber and the second chamber; and d. a rotation locking mechanism coupled with the frame that enables the container to be held in place at a plurality of angles with respect to the frame;

wherein each of the first and second chambers has a lid that enables one or more balls within the chamber to be accessed.

* * * * *